United States Patent [19]

Morgner et al.

[11] Patent Number: 4,706,337

[45] Date of Patent: Nov. 17, 1987

[54] APPARATUS FOR MIXING TEXTILE FIBERS

[75] Inventors: Friedrich W. Morgner, Bergisch Gladbach; Franz Hock, Overath, both of Fed. Rep. of Germany

[73] Assignee: Temafa Textilmaschimenfabrik, Fed. Rep. of Germany

[21] Appl. No.: 856,072

[22] Filed: Apr. 24, 1986

[30] Foreign Application Priority Data

Apr. 27, 1985 [DE] Fed. Rep. of Germany ..... 3515368

[51] Int. Cl.[4] ..... D01G 13/00

[52] U.S. Cl. ..... 19/80 R; 19/145.5

[58] Field of Search ..... 19/80 R, 81, 145.5, 19/145.7, 200, 205

[56] References Cited

U.S. PATENT DOCUMENTS

| | | | |
|---|---|---|---|
| 2,662,250 | 12/1953 | Schweizer | 19/145.5 |
| 2,810,163 | 10/1957 | Kyame et al. | 19/205 X |
| 2,828,510 | 4/1958 | Schweizer | 19/145.5 |
| 3,648,330 | 3/1972 | Binder et al. | 19/145.5 |
| 4,264,241 | 4/1981 | Höck | 19/145.5 X |
| 4,377,021 | 3/1983 | Peters | 19/145.5 X |
| 4,541,144 | 9/1985 | Hoeck | 19/145.5 |

FOREIGN PATENT DOCUMENTS

| | | | |
|---|---|---|---|
| 1202195 | 9/1965 | Fed. Rep. of Germany . | |
| 1014218 | 12/1965 | United Kingdom . | |
| 2142050 | 1/1985 | United Kingdom | 19/145.5 |

*Primary Examiner*—Louis K. Rimrodt

*Attorney, Agent, or Firm*—Kirkpatrick & Lockhart

[57] ABSTRACT

An apparatus for mixing fibers consists of a mixing chamber having a charging device located proximate to a chamber end wall, a fiber conveyor located proximate to the chamber bottom, and a mixing plough located proximate to the chamber end wall opposite the charging device. The fiber material in the mixing chamber is conveyed by means of the fiber conveyor toward the mixing plough. Elimination of the second mixing chamber heretofore necessary for the multiple remixing of the fiber material is accomplished by using a tubular connecting device through which the mixing plough can be connected either to an apparatus for the processing of the fiber material or to the charging device.

3 Claims, 3 Drawing Figures

APPARATUS FOR MIXING TEXTILE FIBERS

BACKGROUND OF THE INVENTION

The invention relates to apparatus for mixing textile fibers.

An apparatus for mixing textile fibers may consist of a mixing chamber, a charging device which effects the charging of the mixing chamber inwardly from a first mixing chamber end wall, a fiber transport apparatus located in the vicinity of the chamber bottom, and a mixer plough located in the vicinity of a second mixing chamber end wall which is opposite the first mixing chamber end wall. The fiber material located in the chamber is guided by means of the fiber transport apparatus to the mixing plough. Such a mixing apparatus is described, for example, in GB-PS No. 1 014 218, dating from the year 1965. In DE-AS No. 12 02 195, also from the year 1965, a machine for mixing fiber material is described in the form of a step separator with a reversible tubular switch. The fiber material is charged through the step separator.

To increase the separation and mixing effect, a portion of the fiber material is generally deposited in a second mixing chamber, so that as a result of the subsequent emptying process, a repeated intensive mixing of the material takes place. The mixing may be, for example, for distributing a softener. In the devices according to the prior art, two mixing chambers and a mixer plough are required. The mixer plough is always at the service of one of the two mixing chambers. Since the mixing chambers, which can be from 3 to 20 m long and from 2 to 4 m wide, take up a lot of space, it is apparent that this mixing system of the prior art is extraordinarily expensive and bulky.

The object of the invention is therefore the creation of an apparatus for the mixing, and specifically the repeated mixing, of textile fibers so that the second mixing chamber can be eliminated to reduce the space occupied by the equipment and to reduce the expense and effort which is currently required for the construction of the second mixing chamber.

SUMMARY OF THE PRESENT INVENTION

An apparatus for mixing fibers comprises a mixing chamber having an end wall and a floor. A charging device charges the chamber with fibers. A fiber transport device is located proximate to the chamber floor for transporting the fibers toward the end wall. A mixing plow is located proximate to the end wall for mixing the fibers. An output device is responsive to the mixing plow for outputting the mixed fibers. A switching device is used for selectively connecting the output device to the charging device for selectively remixing the fibers.

According to another embodiment of the present invention, a fiber spreader has an input for receiving fibers and an output connectable to the charging device. The switching device is additionally capable of connecting the output device of the apparatus to the input of the fiber spreader.

The present invention eliminates one of the two mixing chambers of the prior art thereby providing a mixing apparatus of reduced cost and which requires less space.

BRIEF DESCRIPTION OF THE DRAWINGS

The present invention is described in greater detail with reference to the drawings, wherein.

DESCRIPTION OF A PREFERRED EMBODIMENT

Figure 1:
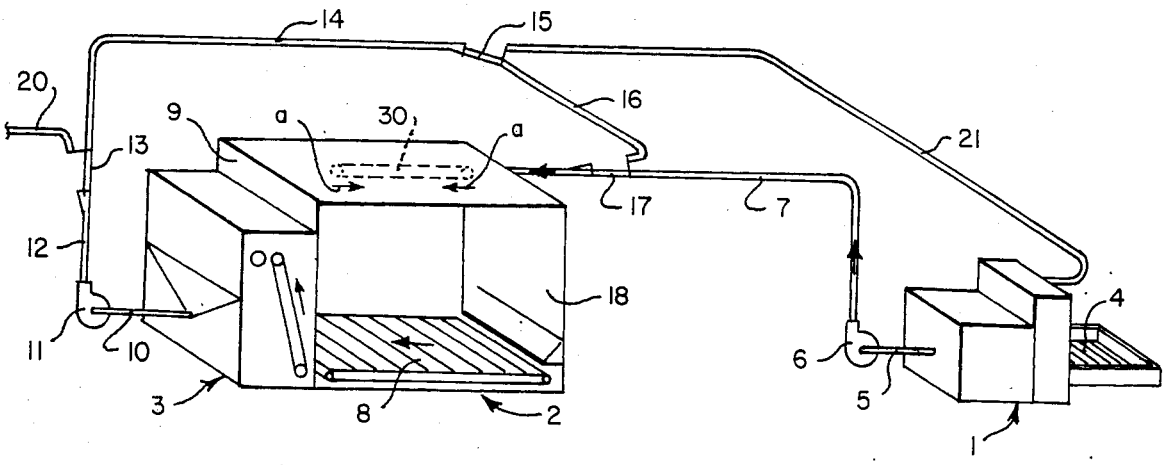
FIG. 1 shows the apparatus of the present invention during initial charging of the mixing chamber.

The apparatus illustrated in FIG. 1 for the mixing of textile fibers consists essentially of a fiber material separator 1, a mixing chamber 2, and a mixer plough 3. The fiber material which is introduced, specifically in the form of bales via a delivery table 4, is separated in the fiber material separator 1. The separated fiber material is conveyed by means of a blower 6, connected via a pipeline 5 to the separator 1, through a line 7 into the mixing chamber 2. The charging of the mixing chamber 2 is done in layers by means of a charging apparatus 30 (shown in dotted lines) which moves alternately back and forth in the direction of the double arrow a. The charging apparatus 30, which preferably has the form of a pneumatic charger, is connected via a telescoping tube to the line 7.

After the filling of the mixing chamber 2, all of the material stock located in the chamber is moved by means of an endless conveyor in the form of a strip conveyor 8 toward the mixer plough 3 located in the vicinity of the forward end wall of the chamber 9 from which the fiber material is removed from bottom to top, and sucked out by means of a blower 1, which is connected to the mixing plough 3 by means of the line 10.

Connected to the pressure side of the blower 11 is a partial line 12 which, by means of a tube connection 13, can be connected either to a line 20, which leads to a processing machine (not shown), or to a partial line 14. Coupled to this partial line 14 via a tube connection 15, there can be either a line 21 leading to the spreader 1, or an intermediate line 16 leading to the line 7 and the charging apparatus 30, which can be connected via a tube connection 17. These connections are shown schematically.

Figure 2:
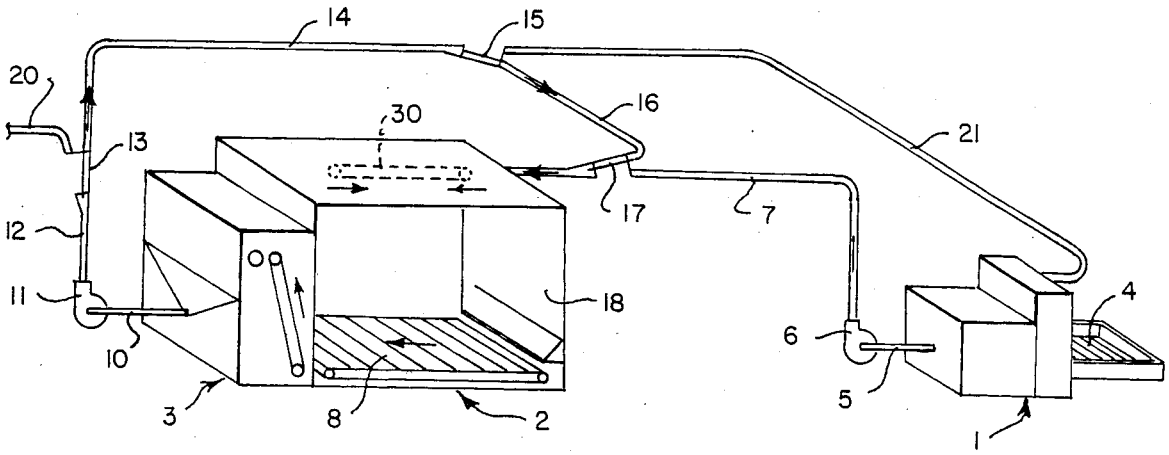
FIG. 2 shows the apparatus of the present invention during the remixing process.

If a portion of the fiber is to be remixed further after the initial mixing process, the tube connections 13, 15, and 17 are switched, e.g. as shown in FIG. 2, so that the fiber material removed from the mixing chamber 2 by means of the mixer plough 3 is again fed inwardly away from the end wall 18 into the mixing chamber 2, and specifically into the area of the chamber which is now empty on account of the material stock being moved by the conveyer 8 toward the mixer plough 3. As a function of the position of the two tube connections 15 and 17, the fiber material for the further remixing process can either be conducted to the mixing chamber 2 directly via the intermediate line 16 (as shown in FIG. 2) or via the line 21, the spreader 1, the line 5, the blower 6, and the line 7.

Figure 3:
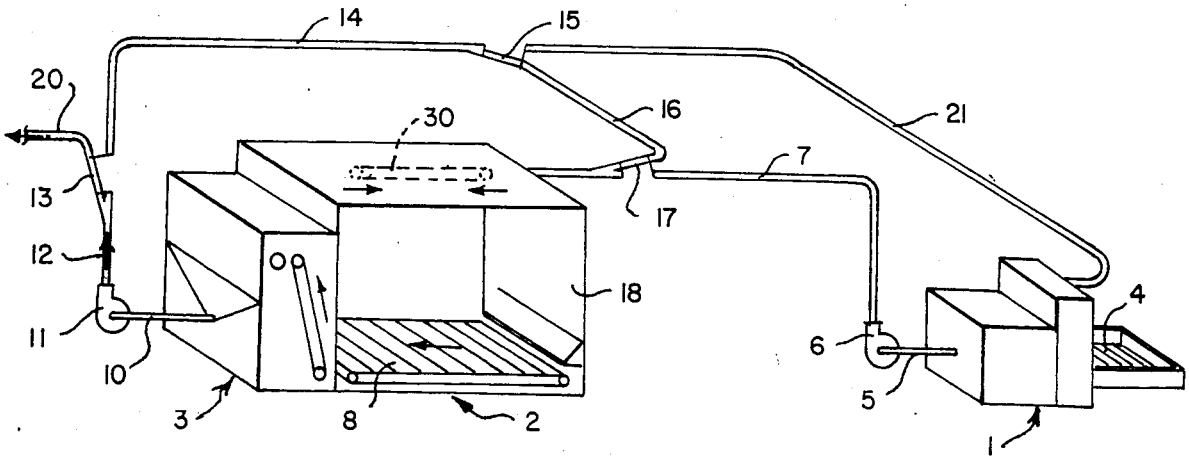
FIG. 3 shows the apparatus of the present invention during the emptying process.

During the subsequent emptying of the mixing chamber for the further processing of the fiber material, the two lines 12 and 20 are connected by means of the tube connection 13 as shown in FIG. 3.

What is claimed is:

1. Apparatus for mixing fibers, comprising:

fiber spreader means capable of receiving fibers in bale form;

a mixing chamber having an end wall and a floor;

moveable means for travelling across said chamber and for charging said chamber with layers of fibers;

fiber conveying means located proximate to said chamber floor for conveying the fibers toward said end wall;

mixing means located proximate to said end wall for mixing the fibers;

output means responsive to said mixing means for outputting said mixed fibers; and means for selectively connecting said output means to one of said charging means and said fiber spreader means for selectively recharging said chamber with said mixed fibers.

2. The apparatus of claim 1 wherein said means for selectively connecting includes a tubular connection.

3. The apparatus of claim 1 wherein said mixing means includes a mixing plough.

* * * * *